United States Patent [19]

Haddad

[11] 4,076,240

[45] * Feb. 28, 1978

[54] HOCKEY STICK

[76] Inventor: Daniel G. Haddad, 25 Columbus St., Worcester, Mass. 01603

[ * ] Notice: The portion of the term of this patent subsequent to Jan. 27, 1993, has been disclaimed.

[21] Appl. No.: 652,425

[22] Filed: Jan. 26, 1976

[51] Int. Cl.[2] ..... A63B 59/14

[52] U.S. Cl. ..... 273/67 A

[58] Field of Search ..... 273/67 A, 67 D, 73 R, 273/73 C, 73 D, 73 F, 76, 167 E; D34/5 BC

[56] References Cited

U.S. PATENT DOCUMENTS

| | | | |
|---|---|---|---|
| D. 192,740 | 5/1962 | Ziabicki | 273/76 X |
| D. 232,450 | 8/1974 | Chreist et al. | 273/76 X |
| D. 237,636 | 11/1975 | Leclerc | 273/67 A X |
| 1,414,124 | 4/1922 | Griffin | 273/167 E X |
| 3,489,412 | 1/1970 | Franck et al. | 273/67 A |
| 3,720,410 | 3/1973 | Saytar | 273/67 A |
| 3,934,876 | 1/1976 | Haddad | 273/73 C |

FOREIGN PATENT DOCUMENTS

| | | | |
|---|---|---|---|
| 16,315 | 2/1934 | Australia | 273/73 C |
| 642,134 | 6/1962 | Canada | 273/167 E |
| 23,845 | 10/1906 | United Kingdom | 273/73 D |
| 607,255 | 8/1948 | United Kingdom | 273/76 |

OTHER PUBLICATIONS

"The Sporting Goods Dealer;" Sep. 1975; p. 199.

*Primary Examiner*—Richard J. Apley
*Attorney, Agent, or Firm*—Norman S. Blodgett; Gerry A. Blodgett

[57] ABSTRACT

A hockey stick having a rigid open cellular network defining the contact surface rather than the conventional laminated wood blade, the network being cast as a single unit and attached to a handle of the conventional shape, the contact surface having a concave curvature.

8 Claims, 6 Drawing Figures

HOCKEY STICK

BACKGROUND OF THE INVENTION

Hockey is a game in which a hard rubber puck is moved around a large playing field by the participants striking the puck with a hockey stick. Although the playing field is usually an ice ring, it also is sometimes a hard permanent surface or a grass area. The hockey stick itself consists of an elongated handle with a blade extending obliquely from one end. The player carries the stick with the blade near the playing surface and makes contact between the blade and the puck at the playing surface.

Because of the hardness and weight of the puck and because of the tremendous forces developed between the blade and the puck at contact, the hockey stick itself must be extremely strong. The requirement that the hockey stick have low swing weight to allow close control of the contact, and the fact that the optimum blade design involves a concave contact surface severely limit the practical designs and construction materials.

Until recently the only practical design involved a wooden blade, normally having several laminations. The blade has contact surfaces on each face, one being concave in curvature and one being convex in order to keep the faces parallel and avoid any unnecessary weight. One difficulty with this configuration of a concave and a convex contact surface, is that, while both surfaces may be used during the course of a game, the concave surface is substantially preferred.

The high expense and physical limitations of the laminated wood hockey stick has resulted in numerous attempts to manufacture the sticks of other materials. The most popular alternative is to make the handle of wood and the blade of molded plastic. It has been found, however, that the use of a plastic with sufficient rigidity and strength to perform the functions necessary adds entirely too much weight to the blade end of the hockey stick. As a result, the plastic substitute forms have been generally confined to the "toy" level. These and other difficulties experienced with the prior art devices have been obviated in a novel manner by the present invention.

It is, therefore, an outstanding object of the invention to provide a hockey stick which can be constructed with a low swing weight and low wind resistance.

Another object of this invention is the provision of a hockey stick having a blade which is generally homogeneous in structure and which can be fabricated by simple mechanical methods.

A further object of the present invention is the provision of a hockey stick which is capable of a long life of useful service with a minimum of maintenance.

Another object of the invention is the provision of a hockey stick which has two opposed concave contact surfaces, so that the stick may be used by either a right-handed or a left-handed person.

A still further object of the invention is the provision of a hockey stick which can be made inexpensively by modern mechanized processes.

It is a further object of the present invention to provide a hockey stick which has high friction contact surfaces to allow the imparting of controlled contact between the blade and the puck.

With these and other objects in view, as will be apparent to those skilled in the art, the invention resides in the combination of parts set forth in the specification and covered by the claims appended hereto.

SUMMARY OF THE INVENTION

This invention involves a hockey stick having an elongated handle and having a blade attached to one end of the handle. The blade consists of a web which defines two-opposed contact surfaces, at least one of which is a concave cylindrical surface. The web is rigidly attached to the handle and consists of a plurality of interconnected plates, each plate having a portion of greatest thickness, a width, and a length, the greatest thickness being substantially less than the width. The length and the greatest thickness are oriented generally parallel to the contact surface. The plates are oriented so that the web is formed as a network of open cells or apertures through the blade.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
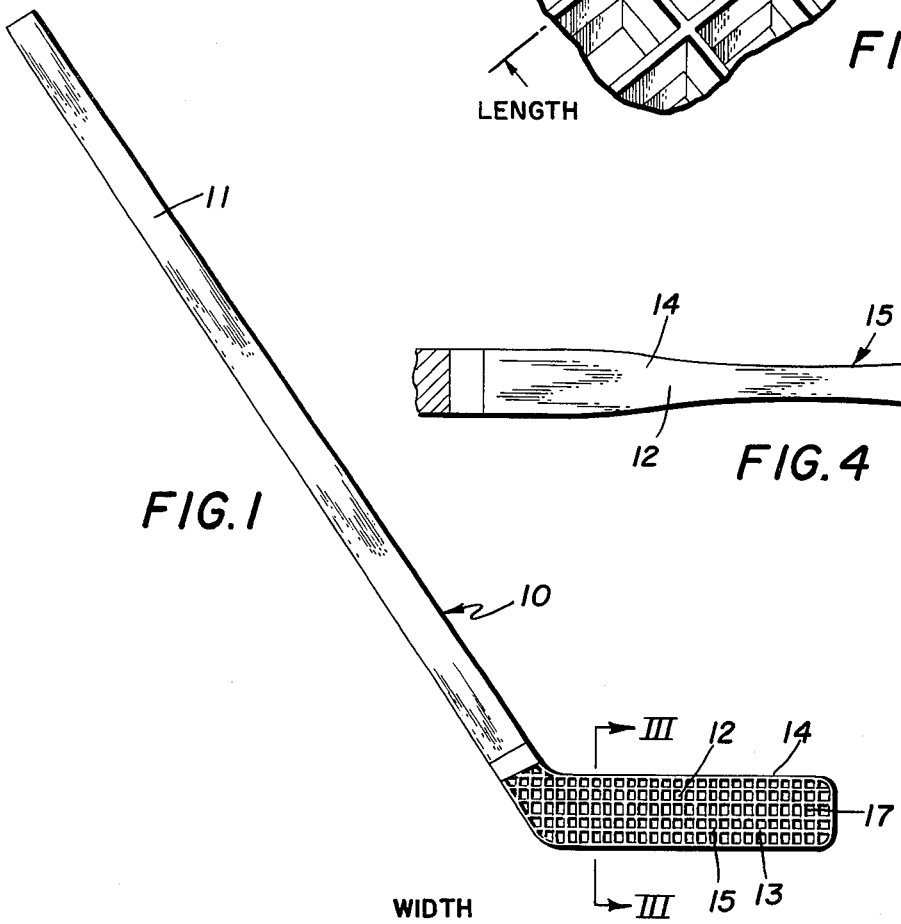
FIG. 1 is a perspective view of a hockey stick embodying the principles of the present invention.

Referring first to FIG. 1, wherein are best shown the general features of the invention, the hockey stick, indicated generally by the reference numeral 10, is shown as having a handle 11, and a planar web 13 at one end of the handle 11. The web 13 is rigidly held with respect to the handle 11, is surrounded by a peripheral rim 14 and defines a generally planer contact surface 15. The blade 12 extends generally at an obtuse angle to the handle 11.

The web 13 is constructed as an open-celled network formed of a plurality of interconnected plates 17. In the preferred embodiment, the plates are oriented either perpendicular to or parallel to the length of the blade. Each plate has a portion of smallest thickness parallel to the contact surface 15, while the other two dimensions (length and width) are oriented, one parallel to and one perpendicular to the contact surface.

Figure 3:
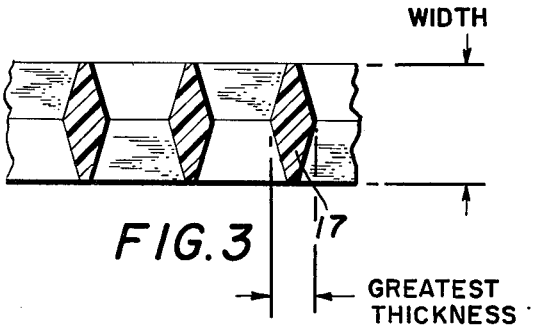
FIG. 3 is a cross-sectional view of the stick taken on the line III—III of FIG. 1.

As shown in the cross-sectional view in FIG. 3, the thickness of the plates vary from one side of the network to the other. In the preferred embodiment, the greatest thickness is at the central portion of the plate, while the smallest thickness exists adjacent the contact surface 15 at either side of the network. A structure in which the greatest thickness is adjacent one contact surface and the smallest thickness is adjacent the other contact surface would also be possible.

Figure 2:
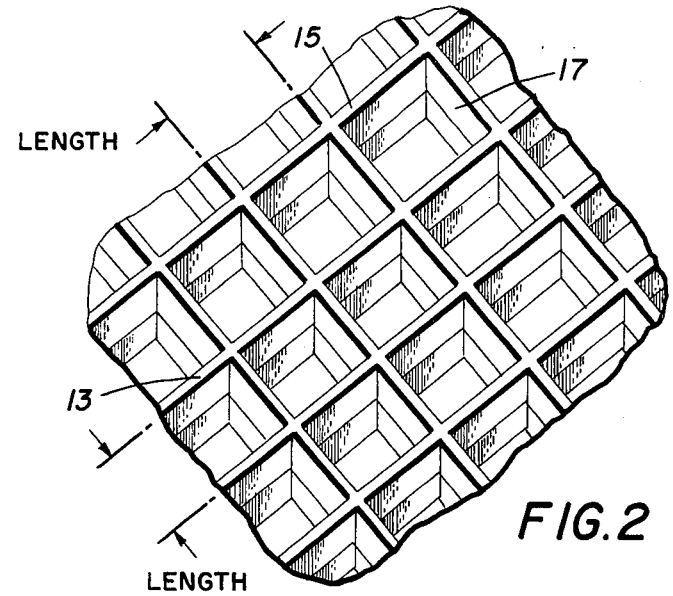
FIG. 2 is an enlarged view of the web and of the contact surface of the hockey stick.
Figure 4:
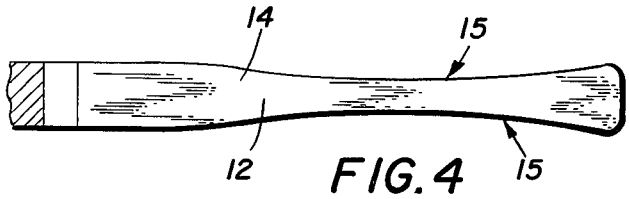
FIG. 4 is a plan view of a portion of the hockey stick shown in FIG. 1.
Figure 6:
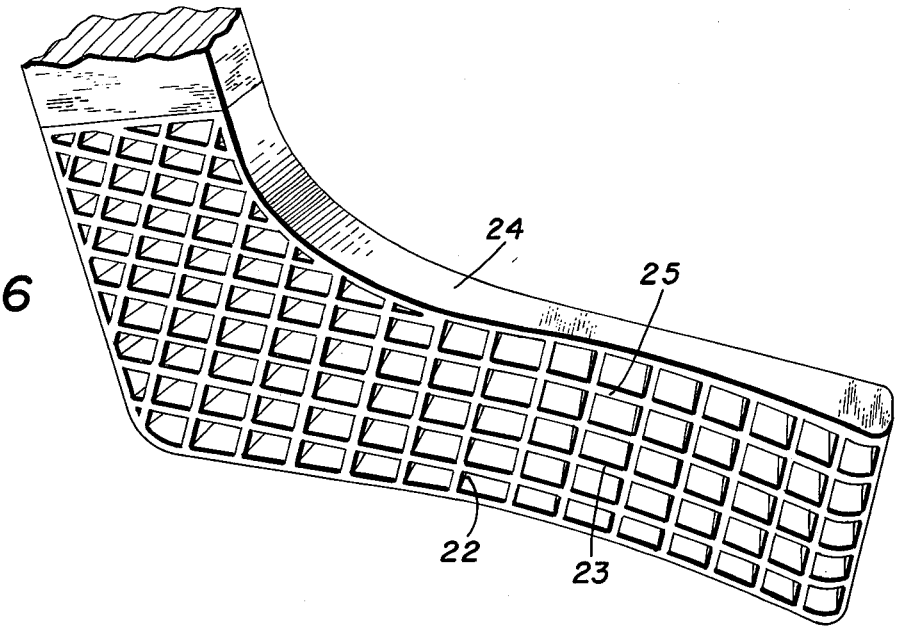
FIG. 6 is a perspective view of a portion of a modified form of the hockey stick.
Figure 5:
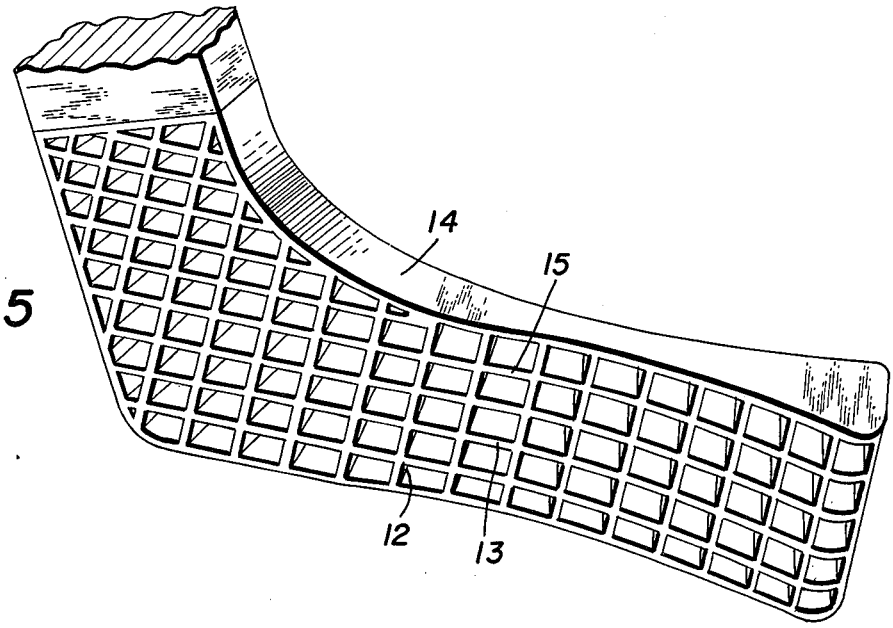
FIG. 5 is a perspective view of a portion of the hockey stick.

Referring to FIG. 4, the two opposed contact surfaces 15 are shown to be both concave cylindrical surfaces. In this way the preferred concave shape exists on both sides of the blade, thus eliminating the right- or left-hand nature which exists in conventional hockey sticks. Although this structure adds to the volume of the blade (because of the open network from which the blade is constructed), there is no substantial addition in weight. This double-concave design is also shown in FIG. 5, whereas the more conventional design is shown in FIG. 6, where the blade 22, including the web 23 and rim 24, define a concave contact surface 25, and a convex contact surface on the hidden side of the web.

The structures recited above have several advantages over normal hockey sticks. The first set of advantages has to do with the simplicity and inexpensiveness of manufacture. The blade with its integral web 13 and peripheral rim 14 may be molded in a single step on a preformed handle. The mold can be of a simple standard design without the necessity of side action. The arrangement of the plates 17 with the web provides a structure which maximizes strength and rigidity and minimizes weight and wind resistance. Because of the simplicity of the manufacturing operation, a whole range of plastic and composite molding materials that are well known in the art can be used.

The second set of advantages has to do with the use of the above-described hockey stick. Clearly, the open structure minimizes weight and wind resistance to allow the maximum force to be brought to bear on the puck. The network structure at the contact surfaces also allows a high friction contact between the blade and the puck. This factor allows non-linear concussion or "english" to be imparted to the puck in both the horizontal and the vertical direction. The concept of the opposed concave contact surfaces 15 allows both surfaces to be the preferred shape for hitting the puck. Thus, the player is not placed at a disadvantage when forced to hit the puck with a "wrong" side of the blade. In addition, the need for separate hockey sticks for right-handed and left-handed persons is eliminated.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A hockey stick, comprising:

a. an elongated handle having an end, and b. a blade having a contact surface, the blade being rigidly mounted on the end of the handle and consisting of a rigid, one-piece, homogenous frame having a head portion consisting of an entirely open-celled network of a plurality of interconnected plates traversing the entire area thereof and forming a honeycomb-like matrix; each of said plates having walls which are perpendicular to the plane of said head portion and constituting the width dimension thereof; each of said plates having planar upper and lower surfaces parallel to the central plane of said head portion, said planar surfaces being exposed at least at said head portion and constituting two contact surfaces of said head portion, the planar surfaces of each of said plates constituting the length dimension thereof; said width dimension being approximately equal to said length dimension; each plate further having a non-uniform thickness with one location of greatest thickness wherein said greatest thickness is less than each of said width and length dimensions and being oriented parallel to said contact surfaces of said head portion.

2. A hockey stick as recited in claim 1, wherein the plates are formed of a rigid material.

3. A hockey stick as recited in claim 1, wherein the plates have a smallest thickness adjacent at least one of the contact surfaces.

4. A hockey stick as recited in claim 1, wherein the entire blade is capable of being cast in a single conventional mold.

5. A hockey stick as recited in claim 1, wherein the plates form a matrix of square apertures.

6. A hockey stick as recited in claim 1, wherein the head portion is surrounded by a peripheral rim.

7. A hockey stick as recited in claim 1, wherein the contact surface has a concave curvature.

8. A hockey stick as recited in claim 1, wherein the head portion defines two opposed contact surfaces each of which has a concave curvature.

* * * * *